US005431835A

United States Patent [19]

Katafuchi et al.

[11] Patent Number: 5,431,835

[45] Date of Patent: Jul. 11, 1995

[54] LUBRICANT REFRIGERANT COMPRISING COMPOSITION CONTAINING FLUOROHYDROCARBON

[75] Inventors: Tadashi Katafuchi; Akira Nakamura, both of Ichihara, Japan

[73] Assignee: Idemitsu Kosan Co., Ltd., Tokyo, Japan

[21] Appl. No.: 176,657

[22] Filed: Jan. 3, 1994

Related U.S. Application Data

[63] Continuation-in-part of Ser. No. 18,136, Feb. 18, 1993, abandoned.

[30] Foreign Application Priority Data

Feb. 18, 1992 [JP] Japan ..... 4-30528
Feb. 17, 1993 [JP] Japan ..... 5-027906

[51] Int. Cl.[6] ..... C09K 5/04; C10M 107/02; C10M 107/34

[52] U.S. Cl. ..... 252/68; 252/52 A; 252/67

[58] Field of Search ..... 252/68, 67, 52 A, 49.6, 252/58

[56] References Cited

U.S. PATENT DOCUMENTS 4,946,611 8/1990 Kaneko ..... 252/49.6
5,084,196 1/1992 Seiki ..... 252/49.6
5,100,569 3/1992 Nalewajek et al. ..... 252/54
5,295,357 3/1994 Kaneko ..... 252/67

FOREIGN PATENT DOCUMENTS 0377122 7/1990 European Pat. Off. .

*Primary Examiner*—Christine Skane
*Attorney, Agent, or Firm*—Antonelli, Terry, Stout & Kraus

[57] ABSTRACT

There has been disclosed herein a lubricant for refrigerating machines employing tetrafluoroethane or the like as a refrigerant which comprises as an essential component a base oil comprising (A) 40 to 95% by weight of a synthetic oil composed of a poly-α-olefin and/or an ethylene/α-olefin copolymer or a mixture of an alkylbenzene and a poly-α-olefin and/or an ethylene/α-olefin copolymer and (B) 5 to 60% by weight of a fluidity improver composed of a polyoxyalkylene glycol compound, etc. The lubricant is used along with a refrigerant comprising a substituted flon compound such as 1,1,1,2-tetrafluoroethane (R-134a), and is excellent in the performance such as wear resistance, electrical insulating properties, hydrolytic stability, nonhygroscopicity, etc. and also in returnability of the lubricant. Thus, the lubricant is especially effective when used in automobile or household air conditioners, refrigerators, etc. having high industrial usefulness.

22 Claims, No Drawings

LUBRICANT REFRIGERANT COMPRISING COMPOSITION CONTAINING FLUOROHYDROCARBON

CROSS-REFERENCE TO RELATED APPLICATION

This is a continuation-in-part application of application, Ser. No. 08/018,136, filed Feb. 18, 1993, now abandoned.

BACKGROUND OF THE INVENTION

1. Field of the Invention

The present invention relates to a lubricant for refrigerating machines employing a refrigerant comprising hydrofluorocarbon such as tetrafluoroethane. More particularly, it relates to a lubricant for refrigerating machines which is used along with a refrigerant comprising a substituted fluorohydrocarbon (hereinafter sometimes referred to as "flon compound") such as 1,1,1,2-tetrafluoroethane (R-134a). As such, the lubricant is excellent in the performance such as wear resistance, electrical insulating properties, hydrolytic stability, nonhygroscopicity and the like and further has excellent returnability of the lubricant in a compression-type refrigerating cycle (the characteristics that the lubricant is inclined to return to a compressor after it is circulated in the refrigerating cycle).

2. Description of the Related Arts

Conventionally, in a compression-type refrigerating cycle comprising a compressor, a condenser, an expansion valve and an evaporator, a flon compound including a fluorinated hydrocarbon such as dichlorodifluoromethane (R-12) and chlorodifluoromethane (R-22) has been used as the refrigerant. Many kinds of lubricants compatible with them have also been produced industrially available for use.

However, there have been misgivings that these flon compounds widely used as the refrigerant are liable to cause depletion of the ozone layer and environmental pollution after they are released into the open air. In an effort to prevent environmental pollution, fluorohydrocarbons (or chlorofluorohydrocarbons), for example 1,1,1,2-tetrafluoroethane (R-134a) and the like have been developed as a possible replacement in recent years. Until now there have been introduced into market many so-called substituted flon compounds with minimized danger of environmental pollution and capable of satisfying said required properties, for example 1,1,2,2-tetrafluoroethane (R-134) and the like, as well as R-134a.

These new substituted flon refrigerants are different from conventional flon refrigerants in characteristics. Thus, glycol compounds, ester compounds and the like have been proposed as the lubricant for use in combination with them (U.S. Pat. No. 4,755,316 and Japanese Patent Application Laid-Open No.33193/1991), and these patents are intended to dissolve substituted flon refrigerants and lubricants completely so as to provide good returnability of the lubricants.

In an attempt to circulate all over a refrigerating cycle a refrigerant and a lubricant in their completely dissolved state as envisaged by these patents, however, said lubricant must be selected from only a very limited number of compounds acceptable to the chemical properties of substituted flon refrigerants such as R-134a. Accordingly, the selected lubricant is forced to sacrifice certain aspects of the important performance required as the lubricant.

In fact, polyalkylene glycol compounds and ester compounds thereof, both known as compatible with R-134a, have been found to have insufficient wear resistance, along with faulty electrical insulating properties. It has also been found that the polyalkylene glycol compounds are highly hygroscopic and the ester compounds thereof are hydrolytically unstable. Thus the demand for a solution in these problems has been raised in relevant industrial segments.

The present invention has been completed on the basis of a concept quite contrary to ordinary common knowledge as set forth above, in an effort to find a solution in the problems. As the result, it has been found that all these aspects of the performance can be unified by using a substance excellent in wear resistance, insulation resistance and the like as the lubricant, compounding therewith a fluidity improver to improve the fluidity of the lubricant in the presence of a refrigerant (R-134a and the like) and thus providing good returnability of the lubricant in a compression-type refrigerating cycle. It has thus been made possible that a lubricant combined even with a new refrigerant has all the required performance including excellent wear resistance, electrical insulating properties, hydrolytic stability and the like and further ensuring excellent returnability of the lubricant. The present invention has been accomplished based on this finding.

SUMMARY OF THE INVENTION

Therefore, an object of the present invention is to provide a lubricant for refrigerating machines employing a refrigerant comprising tetrafluoroethane or the like, which is excellent in the performance such as wear resistance, electrical insulating properties, hydrolytic stability, nonhygroscopicity and the like and further has excellent returnability of the lubricant. The lubricant can be used along with a substituted flon refrigerant in a compression-type refrigerating cycle without a hitch.

Another object of the present invention is to provide a lubricant for refrigerating machines employing a refrigerant comprising tetrafluoroethane or the like, which is especially effective when used in automobile or household air conditioners and refrigerators and the like, having high industrial usefulness.

The present invention provides a lubricant for refrigerating machines employing a refrigerant comprising tetrafluoroethane or the like which comprises as an essential component a base oil comprising (A) 40 to 95% by weight of a synthetic oil composed of at least one member selected from the group consisting of a poly-$\alpha$-olefin and an ethylene/$\alpha$-olefin copoylmer or a mixture of an alkylbenzene and at least one member selected from the group consisting of a poly-$\alpha$-olefin and an ethylene/$\alpha$-olefin copolymer and (B) 5 to 60% by weight of a fluidity improver comprising at least one compound selected from the group consisting of a polyoxyalkylene glycol compound, a polysiloxane compound and a fluoride of a polysiloxane compound.

The lubricant of the present invention can be suitably used in various refrigerating machines and ordinarily in a compression-type refrigerating cycle comprising a compressor, a condenser, an expansion valve and an evaporator.

DESCRIPTION OF PREFERRED EMBODIMENTS

As set forth above, the lubricant of the present invention comprises the components (A) and (B) as the essential components, and the synthetic oil constituting the component (A) is at least one member selected from the group consisting of a poly-α-olefin and an ethylene/α-olefin copolymer or a mixture of an alkylbenzene and at least one member selected from the group consisting of a poly-α-olefin and an ethylene/α-olefin copolymer.

Various poly-α-olefins can be used and ordinarily are each a polymer of α-olefin having 8 to 14 carbon atoms and a kinematic viscosity of 10 to 350 cSt at 40° C. Preferred among them is a polymer of 1-dodecene, a polymer of 1-decene or a polymer of 1-octene, each having a kinematic viscosity of 10 to 350 cSt at 40° C. In addition, a hydrogenated poly-α-olefin is included in the scope of the invention. A lubricant containing a synthetic oil comprising such a poly-α-olefin has a lower viscosity at low temperatures in the presence of a tetrafluoroethane refrigerant, and thus returnability of the lubricant is all the more improved.

The ethylene/α-olefin copolymer is available from a variety of species and is exemplified by a copolymer of ethylene and an α-olefin having 3 to 12 carbon atoms such as propylene, 1-butene, 1-hexene, 1-octene, 1-decene and 1-dodecene. Among the copolymers, ethylene/propylene copolymer is particularly preferable. In addition, a hydrogenated poly-α-olefin is included in the scope of the present invention. The content of the ethylene unit in the copolymer is not specifically limited, but is preferably in the range of 25 to 80 mol. %. The method of polymerizing the monomer and comonomer is not specifically limited, but may be any of the conventional known methods.

The above-mentioned poly-α-olefin and ethylene/α-olefin copolymer may be mixed in an arbitrary mixing ratio without spefcific limitation.

Various alkylbenzenes can be used as well and ordinarily are each an alkylbenzene having a kinematic viscosity of 5 to 500 cSt, preferably 10 to 350 cSt at 40° C. Meanwhile, either soft or hard alkylbenzene can be used provided that it meets this condition.

The alkylbenzene is not used singly but in the form of a mixture thereof with said poly-α-olefin and/or ethylene/α-olefin copolymer as the synthetic oil as the component (A) in the present invention. The mixing ratio of the poly-α-olefin and/or ethylene/α-olefin copolymer (hereinafter referred to simply as "olefinic polymer" to the alkylbenzene may be appropriately selected according to circumstances and is not particularly limited. Preferably the mixture has a poly-α-olefin content of 5% or more by weight, more preferably 5 to 90% by weight, most preferably 5 to 50% by weight of the mixture when using an olefinic polymer having a kinematic viscosity of 50 cSt at 40° C. When such a mixture of the olefinic polymer and alkylbenzene is used as the synthetic oil as the component (A), the mixing stability of the olefinic polymer and the fluidity improver as the component (B) is improved. This effect is especially remarkable with the use of a polyoxyalkylene glycol compound as the fluidity improver.

On the other hand, the fluidity improver acts to improve the fluidity of a hydrocarbonic compound at low temperatures (those of the evaporator) in the presence of a small amount of substitute flon refrigerant such as R-134a, so as to provide good returnability of the lubricant in the refrigerating cycle. The kinematic viscosity of the fluidity improver is not particularly limited but is ordinarily 2 to 100 cSt, preferably 3 to 50 cSt at 40° C.

A typical example thereof is a polyoxyalkylene glycol compound. Various polyoxyalkylene glycol compounds can be used and an appropriate one may be selected from them according to the intended use. Preferred among them is a polyoxyalkylene glycol compound represented by the general formula (I):

$$R^1\text{-}[(OR^2)_m OR^3]_n \qquad (I)$$

wherein $R^1$ is a hydrogen atom, an alkyl group having 1 to 10 carbon atoms, an alkenyl group having 2 to 10 carbon atoms, an alkynyl group having 2 to 10 carbon atoms, an aryl group having 6 to 10 carbon atoms, an aralkyl group having 7 to 10 carbon atoms, an acyl group having 2 to 10 carbon atoms or an aliphatic hydrocarbon group having 2 to 6 bonding links; $R^2$ is an alkylene group having 2 to 6 carbon atoms; $R^3$ is a hydrogen atom, an alkyl group having 1 to 10 carbon atoms, an alkenyl group having 2 to 10 carbon atoms, an alkynyl group having 2 to 10 carbon atoms, an aryl group having 6 to 10 carbon atoms, an aralkyl group having 7 to 10 carbon atoms or an acyl group having 2 to 10 carbon atoms; n is an integer of 1 to 6; and m is a figure satisfying that the average value of $m \times n$ is 2 to 40.

The alkyl group having 1 to 10 carbon atoms may be straight chain, branched chain or cyclic. Specific examples of the alkyl group include a methyl group, an ethyl group, a n-propyl group, an isopropyl group, various butyl groups, various pentyl groups, various hexyl groups, various heptyl groups, various octyl groups, various nonyl groups, various decyl groups, a cyclopentyl group and a cyclohexyl group. Specific example of the aryl group include a phenyl group, and those of aralkyl group include a tolyl group, a xylyl group, a benzyl group, a phenethyl group and the like.

An alkyl group having more than 10 carbon atoms leads to the degradation of the effect on improving the fluidity of the lubricant. The alkyl group has preferably 1 to 6 carbon atoms.

An alkyl moiety of said acyl group may be straight chain, branched chain or cyclic. Specific examples of the alkyl moiety of the acyl group include a methyl group, an ethyl group, a n-propyl group, an isopropyl group, various butyl groups, various pentyl groups, various hexyl groups, various heptyl groups, various octyl groups, various nonyl groups, a cyclopentyl group, a cyclohexyl group and the like. An acyl group having more than 10 carbon atoms leads to the degradation of the effect on improving the fluidity of the lubricant. The acyl group has preferably 2 to 6 carbon atoms.

Said $R^1$ and $R^3$ may be same or different one another.

Furthermore, a plurality of R3s in a molecule may be same or different when n is 2 or more.

When $R^1$ is an aliphatic hydrocarbon group having 1 to 10 carbon atoms and 2 to 6 bonding links, the aliphatic hydrocarbon group may be either chain or cyclic. Examples of the aliphatic hydrocarbon group having 2 bonding links include an ethylene group, a propylene group, a butylene group, a pentylene group, a hexylene group, a heptylene group, an octylene group, a nonylene group, a decylene group, a cyclopentylene group, a cyclohexylene group, a vinyl group, an allyl group, a butenyl group, an ethynyl group, a propynyl group, and the like. Examples of the aromatic hydrocarbon group include a phenyl group, a tolyl group, a xylyl group, a benzyl group, a pheneythyl group and the like. Examples of the aliphatic hydrocarbon group having 3 to 6 bonding links include a residue after a hydroxyl group is removed from a polyhydric alcohol such as trimethylolpropane, glycerin, pentaerythritol, dipentaerythritol, sorbitol, 1,2,3-trihydroxycyclohexane and 1,3,5-trihydroxyoyclohexane.

An aliphatic hydrocarbon group having more than 10 carbon atoms leads to the degradation of the effect on improving the fluidity of the lubricant. The aliphatic hydrocarbon has preferably 2 to 6 carbon atoms. $R^2$ in said general formula (I) is an alkylene group having 2 to 6 carbon atoms and examples of the oxyalkylene group as a repeating unit include an oxyethylene group, an oxypropylene group, an oxybutylene group, an oxypentylene group and an oxyhexylene group. A molecule thereof may comprise either same oxyalkylene groups or two or more different kinds of oxyalkylene groups. Preferably a molecule thereof comprises the alkylene groups each having at least 3 carbon atoms, more preferably 50% or more by mole of same or different alkylene groups each having at least 4 carbon atoms per oxyalkylene unit and 50% or less by mole of same or different alkylene groups each having 2 to 3 carbon atoms per oxyalkylene unit for each molecule. Alternatively, the polyalkylene glycol compound may be a mixture of 50% to 100% by mol of said compound containing same or different alkylene groups each having at least 4 carbon atoms per oxyalkylene unit and 50% to 0% by mol of said compound containing same or different alkylene groups each having 2 to 3 carbon atoms per oxyalkylene unit. Specifically the oxyalkylene group may either be homopolymerized with each other or copolymerized with at least one other copolymerizable oxyalkylene group. In addition, the resultant homopolymerized or copolymerized oxyalkylene glycol compound may be used alone or in combination with at least one other such homopolymerized or copolymerized oxyalkylene glycol compound.

n in said general formula (I) is an integer of 1 to 6 and depends on the number of bonding links of $R^1$. For example, when $R^1$ is a hydrogen atom, an alkyl group, an alkenyl group, an alkynyl group, an aryl group or an acyl group, n is 1. When $R^1$ is an aliphatic hydrocarbon group having 2, 3, 4, 5 or 6 bonding links, n is 2, 3, 4, 5 or 6, respectively. Further, m is a figure satisfying that the average value of $m \times n$ is 2 to 40, and when the average value of $m \times n$ is out of said range, the object of the present invention is not achieved to a full extent.

Other than set forth above, examples of the polyoxyalkylene glycol compound for use in the present invention include a polyoxyalkylene glycol compound containing at least one constitutional unit represented by the general formula (II):

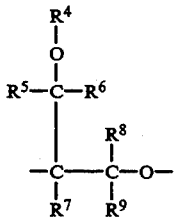

(II)

wherein $R^4$ is a monovalent hydrocarbon group having 1 to 10 carbon atoms and $R^5$ to $R^9$ are each a hydrogen atom or a monovalent hydrocarbon group having 1 to 10 carbon atoms.

Various polyoxyalkylene glycol compounds other than enumerated above can be used in the present invention as well, including those having a glycidyl group, those having a carbonyl bond in the molecule, those resulting from the substitution by a fluorine atom and the like.

Of the above-mentioned polyoxyalkylene glycol compounds, a polyoxypropylene glycol compound, a polyoxybutylene glycol compound, a polyoxypentylene glycol compound and a polyoxyhexylene glycol compound are preferably used in the present invention because of their improvement in the mixing stability. Most suitable is a fluidity improver containing 50% or more of at least one compound selected from the group consisting of the polyoxybutylene glycol compound, the polyoxypentylene glycol compound and the polyoxyhexylene glycol compound. It is also preferable that a polyoxyalkylene glycol compound should contain the oxybutylene, oxypentylene and oxyhexylene units to make a total of 50 or more among oxyalkylene units forming the compound.

Furthermore, a polysiloxane compound such as dimethylpolysiloxane and a fluoride thereof can be used as the fluidity improver in the present invention as well. It is also effective to use a mixture of 2 or more different fluidity improvers.

The synthetic oil (A) and the fluidity improver (B) are mixed in a ratio by weight of 40 to 95%, desirably 50 to 90%, particularly desirably 60 to 90% of (A) to 5 to 60%, desirably 10 to 50%, particularly desirably 10 to 40%, respectively of (B).

When less than 5% by weight of the fluidity improver is used, the fluidity of the lubricant is undesirably not improved and therefore the sufficient returnability of the lubricant is not achieved as well. On the other hand, when more than 60% by weight of the fluidity improver is used, wear resistance and the like are undesirably degraded. This is accompanied by the degradation of the fundamental performance required for refrigerating machine lubricant, including the reduction of insulation resistance, worsening of hydrolytic stability, the increase in hygroscopicity and the like.

The lubricant of the present invention comprises as the essential component the base oil comprising the synthetic oil (A) and the fluidity improver (B) as set forth above and as the need arises various additives can be incorporated therein. Examples of the additive include an anti-wear additive such as phosphoric acid ester and phosphorous acid ester, an antioxidant, a chlorine scavenger, a metal deactivator, a defoaming agent, a detergent-dispersant, a viscosity index improver, a rust preventive, a corrosion inhibitor and the like.

There are available a variety of refrigerants comprising flon compounds (substituted fluorohydrocarbon-based refrigerants) to be used in refrigerating machines in which a lubricant of the present invention is employed. Examples of such refrigerants include 1,1,1,2-tetrafluoroethane (R-134a); 1,1,2,2-tetrafluoroethane (R-134); 1,1-difluoroethane (R-152a); pentafluoroethane (R-125); trifluoromethane (R-23); difluoromethane (R-32); 1,1,1-trifluoroethane (R-143a); and a mixed refrigerant such as a mixture of R-134a and R-125; R-134a and R-32; R-134a, R-125a and R-32; R-143a and R-125; or R-143a, R-125 and R-134a.

As set forth above, the lubricant for refrigerating machines employing the refrigerant comprising tetrafluoroethane as claimed herein is excellent in the performance such as wear resistance, electrical insulating properties, hydrolytic stability, nonhygroscopicity and the like and further has excellent returnability of the lubricant. The lubricant of the present invention can be used along with a substitute flon refrigerant in a compression-type refrigerating cycle without a hitch.

The lubricant of the present invention is especially effective when used in automobile or household air conditioners, refrigerators and the like, having high industrial usefulness.

Next, the present invention will be described in greater detail below, with reference to non-limitative examples and comparative examples.

Examples 1 to 8 and Comparative Examples 1 to 4

The synthetic oils and the fluidity improvers were each mixed as shown in Table 1 to prepare the lubricants for use in the following tests. The results thereof are given in Table 2.

TABLE 1

| | Mixing Composition | | | |
|---|---|---|---|---|
| | Synthetic Oil | | | |
| | Compound | Wt % | Fluidity Improver Compound | Wt % |
| Example 1 | Poly-α-olefin*1 | 30 | Polyglycol compound A*4 | 20 |
| | Alkylbenzene*2 | 50 | | |
| Example 2 | Poly-α-olefin*1 | 10 | Polyglycol compound A*4 | 20 |
| | Alkylbenzene*2 | 70 | | |
| Example 3 | Poly-α-olefin*1 | 80 | Polyglycol compound B*5 | 10 |
| | | | Ester A*6 | 10 |
| Example 4 | Poly-α-olefin*1 | 50 | Polyglycol compound B*5 | 10 |
| | Alkylbenzene*3 | 30 | Ester A*6 | 10 |
| Example 5 | Poly-α-olefin*1 | 20 | Polyglycol compound A*4 | 30 |
| | Alkylbenzene*2 | 50 | | |
| Example 6 | Poly-α-olefin*1 | 20 | Polyglycol compound A*4 | 16 |
| | Alkylbenzene*2 | 60 | Polyglycol compound B*5 | 4 |
| Example 7 | Poly-α-olefin*1 | 80 | Polyglycol compound*4 | 20 |
| Example 8 | Ethylene/propylene copolymer*8 | 80 | Polyglycol compound*4 | 20 |
| Comparative Example 1 | Alkylbenzene*2 | 80 | Ester B*7 | 20 |
| Comparative Example 2 | Poly-α-olefin*1 | 30 | Ester A*6 | 70 |
| Comparative Example 3 | Poly-α-olefin*1 | 10 | Ester B*1 | 80 |
| | Alkylbenzene*3 | 10 | | |
| Comparative Example 4 | Mineral oil*9 | 80 | Polyglycol compound*4 | 80 |

TABLE 2

| | Performance | |
|---|---|---|
| | Fluidity at low temperatures (relative value) | Wear resistance |
| Example 1 | 20 | ○ |
| Example 2 | 25 | ○ |
| Example 3 | 16 | ○ |
| Example 4 | 30 | ○ |
| Example 5 | 18 | ○ |
| Example 6 | 20 | ○ |
| Example 7 | 14 | ○ |
| Example 8 | 14 | ○ |
| Comparative Example 1 | 100 | ○ |
| Comparative Example 2 | 20 | X |
| Comparative Example 3 | 20 | X |
| Comparative Example 4 | 100 | ○ |

TABLE 2-continued

| | Performance | | |
|---|---|---|---|
| | Insulation resistivity (Ω · cm) | Hydrolysis | Hygroscopicity |
| Example 1 | $4.8 \times 10^{14}$ | ○ | ○ |
| Example 2 | $4.5 \times 10^{14}$ | ○ | ○ |
| Example 3 | $2.2 \times 10^{14}$ | ○ | ○ |
| Example 4 | $3.5 \times 10^{14}$ | ○ | ○ |
| Example 5 | $1.5 \times 10^{14}$ | ○ | ○ |
| Example 6 | $4.7 \times 10^{14}$ | ○ | ○ |
| Example 7 | $2.0 \times 10^{14}$ | ○ | ○ |
| Example 8 | $2.0 \times 10^{14}$ | ○ | ○ |
| Comparative Example 1 | $3.0 \times 10^{14}$ | ○ | ○ |
| Comparative Example 2 | $1.5 \times 10^{13}$ | X | Δ |
| Comparative Example 3 | $1.2 \times 10^{13}$ | X | Δ |
| Comparative Example 4 | $2.2 \times 10^{14}$ | ○ | ○ |

All the lubricants used were mixed with 0.5% by weight of an anti-wear additive (phosphoric acid ester). The notes in the tables will be supplemented below:

*1: A polymer of 1-decene (a kinematic viscosity of 32 cSt at 40° C.).

*2: Soft alkylbenzene (a kinematic viscosity of 38 cSt at 40° C.).

*3: Hard alkylbenzene (a kinematic viscosity of 32 cSt at 40° C.).

*4: Polyoxybutylene glycol dimethyl ether (a kinematic viscosity of 32 cSt at 40° C.).

*5: Polyoxypropylene glycol dimethyl ether (a kinematic viscosity of 28 cSt at 40° C.).

*6: An ester of $C_7$ fatty acid and pentaerythritol (a kinematic viscosity of 30 cSt at 40° C.).

*7: An ester of $C_7$ fatty acid and trimethylolpropane (a kinematic viscosity of 14 cSt at 40° C.).

*8: Ethylene/propylene copolymer with ethylene unit content of 55 mol. % (a kinematic viscosity of 32 cSt at 40° C.).

*9: A paraffinic oil (a kinematic viscosity of 30 cSt at 40° C.).

The lubricants were evaluated by determining each aspect of the performance thereof in accordance with the following test method:

Evaluation of the performance (1) Fluidity of the lubricants at low temperatures A lubricant mixed with 10% of R-134a was collected into a pressure glass tube having a diameter of 8 mm, then a steel ball of 3/16in. in diameter was introduced therein and the pressure glass tube was sealed.

After the pressure glass tube was retained at −45° C., the steel ball was caused to fall to determine the time (second) required until the steel ball reached a point 10 cm to 5 cm above the bottom of the tube. The result thereof is given in terms of relative value.

(2) Wear resistance

The wear test was conducted under the following conditions by using a Falex friction testing machine.

R-134a was blown at a rate of 5 liter/hour, and a test piece was subjected to wear for 60 minutes under a load of 300 lbs and at 1,000 rpm. Meanwhile, the test pieces such as block and pin were made of a standard material in accordance with ASTM D-3233.

Standard of evaluation (wear amount)

○: less than 6.0 mg

Δ: 6.0 mg or more to 15 mg or less x: more than 15 mg (3) Electrical insulating properties The electrical insulating properties was evaluated mutatis mutandis according to JIS C-2101 to determine the volume resistivity (room temperature).

(4) Hydrolytic stability 100 g of a lubricant, 10 g of R-134a, 5 ml of water and copper and iron catalysts were placed in a pressure container having a capacity of 300 cc. Then, the pressure container was sealed and retained at 100° C. for 5 days and thereafter the rate of a rise in the total acid number was determined.

Standard of evaluation

○: less than 0.01 mgKOH/g

Δ: 0.01 mgKOH/g or more to 0.1 mgKOH/g or less x: more than 0.1 mgKOH/g (5) Hygroscopicity 10 g of a test sample was placed in a 50 cc glass container having a diameter of 30 mm. The glass container was introduced into a thermostat-humidistat and allowed to stand for 5 days at a temperature of 25° C. and under a humidity of 85% and thereafter the water content in the test sample was determined.

Standard of evaluation

○: less than 0.03%

Δ: 0.03% or more to 0.1% or less x: more than 0.1%

Examples 9 to 11

The lubricant, that is, the mixture of the synthetic oil and fluidity improver which lubricant is the same as that in Example 5 was tested in accordance with the testing procedure in Examples 1 to 8 and Comparative Examples 1 to 4 except that any of the refrigerants R-125, a mixture of R-134a and R-32 (70:30 by volume) and a mixture of R-143a and R-125 (50:50 by volume) was used in place of R-134a. The results thereof are given in Table 3.

TABLE 3

| | Refrogeramt | Performance | | | | |
|---|---|---|---|---|---|---|
| | | Fluidity at low temperatures (relative value) | Wear resistance | Insulation resistivity (Ω · cm) | Hydrolysis | Hygroscopicity |
| Example 9 | R-125 | 16 | ○ | $1.5 \times 10^{14}$ | ○ | ○ |
| Example 10 | R-134a + R-32 (70:30) | 18 | ○ | $1.5 \times 10^{14}$ | ○ | ○ |
| Example 11 | R-143a + R-125 (50:50) | 17 | ○ | $1.5 \times 10^{14}$ | ○ | ○ |

What is claimed is:

1. A lubricant composition for a compression-type refrigerating machine, said composition comprising at least one refrigerant selected from the group consisting of 1,1,1,2-tetrafluoroethane (R-134a), 1,1,2,2-tetrafluoroethane (R-134), pentafluoroethane (R-125), difluoromethane (R-32) and 1,1,1-trifluoroethane (R-143a), and a lubricant comprising (A) 60 to 90% by weight of a synthetic oil composed of (A-1) at least one member selected from the group consisting of a poly-α-olefin and an ethylene/α-olefin copolymer or (A-2) a mixture of an alkylbenzene and at least one member selected from the group consisting of a poly-α-olefin and an ethylene/α-olefin copolymer and (B) 10 to 40% by weight of a fluidity improver composed of a polyoxyalkylene glycol compound.

2. The lubricant composition according to claim 1, wherein said poly-α-olefin is a polymer of an α-olefin having 8 to 14 carbon atoms and a kinematic viscosity of 10 to 350 cSt at 40° C.

3. The lubricant composition according to claim 2, wherein said polymer of an α-olefin is a polymer of 1-dodecene, 1-decene or 1-octene, each having a kinematic viscosity of 10 to 350 cSt at 40° C.

4. The lubricant composition according to claim 1, wherein said ethylene/α-olefin copolymer is a copolymer of ethylene and an α-olefin selected from the group consisting of propylene, 1-butene, 1-hexene, 1-octene, 1-decene and 1-dodecene.

5. The lubricant composition according to claim 1, wherein said alkylbenzene is selected from the group consisting of a soft alkylbenzene and a hard alkylbenzene, each having a kinematic viscosity of 10 to 350 cSt at 40° C.

6. The lubricant composition according to claim 1, wherein said mixture of the alkylbenzene and at least one member selected from the group consisting of a poly-α-olefin and an ethylene/α-olefin copolymer has an olefinic polymer content of 5 to 90% by weight of the mixture.

7. The lubricant composition according to claim 1, wherein said fluidity improver as the component (B) has a kinematic viscosity of 3 to 50 cSt at 40° C.

8. The lubricant composition according to claim 1, wherein said polyoxyalkylene glycol compound is represented by the general formula (I):

$$R^1 [(OR^2)_m OR^3]_n \quad (I)$$

wherein $R^1$ is a hydrogen atom, an alkyl group having 1 to 10 carbon atoms, an alkenyl group having 2 to 10 carbon atoms, an alkynyl group having 2 to 10 carbon atoms, an aryl group having 6 to 10 carbon atoms, an aralkyl group having 7 to 10 carbon atoms, an acyl group having 2 to 10 carbon atoms or an aliphatic hydrocarbon group having 2 to 6 bonding links; $R^2$ is an alkylene group having 2 to 6 carbon atoms; $R^3$ is a hydrogen atom, an alkyl group having 1 to 10 carbon atoms, an alkenyl group having 2 to 10 carbon atoms, an alkynyl group having 2 to 10 carbon atoms, an aryl group having 6 to 10 carbon atoms, an aralkyl group having 7 to 10 carbon atoms or an acyl group having 2 to 10 carbon atoms; n is an integer of 1 to 6; and m is a figure satisfying that the average value of m×n is 2 to 40.

9. The lubricant composition according to claim 1, wherein said polyoxyalkylene glycol compound contains 50% or more by mole of same or different alkylene groups each having at least 4 carbon atoms per oxyalkylene unit and 50% or less by mole of same or different alkylene groups each having 2 to 3 carbon atoms per oxyalkylene unit for each molecule.

10. The lubricant composition according to claim 1, wherein said polyoxyalkylene glycol compound is a mixture of 50% to 100% by mole of said compound containing same or different alkylene groups each having at least 4 carbon atoms per oxyalkylene unit and 50% to 0% by mole of said compound containing same or different alkylene groups each having 2 to 3 carbon atoms per oxyalkylene unit.

11. The lubricant composition according to claim 1, wherein said polyoxyalkylene glycol compound contains at least one constitutional unit represented by the general formula (II):

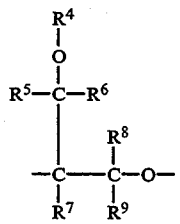

(II)

wherein $R^4$ is a monovalent hydrocarbon group having 1 to 10 carbon atoms; and $R^5$ to $R^9$ are each a hydrogen atom or a monovalent hydrocarbon group having 1 to 10 carbon atoms.

12. The lubricant composition according to claim 1, wherein said polyoxyalkylene glycol compound is a polyoxypropylene glycol compound, a polyoxybutylene glycol compound, a polyoxypentylene glycol compound or a polyoxyhexylene glycol compound.

13. The lubricant composition according to claim 1, wherein said fluidity improver of component (B) comprises 50% or more of at least one compound selected from the group consisting of a polyoxybutylene glycol compound, a polyoxypentylene glycol compound and a polyoxyhexylene glycol compound.

14. The lubricant composition according to claim 1, wherein said polyoxyalkylene glycol compound contains oxybutylene units, oxypentylene units and oxyhexylene units to make a total of 50 or more among oxyalkylene units forming the compound.

15. The lubricant composition according to claim 1, wherein said refrigerant is R-134a.

16. The lubricant composition according to claim 1, wherein said refrigerant is R-125.

17. The lubricant composition according to claim 1, wherein said refrigerant is R-143a.

18. The lubricant composition according to claim 1, wherein said refrigerant is a mixture of R-134a and R-125.

19. The lubricant composition according to claim 1, wherein said refrigerant is a mixture of R-134a and R-32.

20. The lubricant composition according to claim 1, wherein said refrigerant is a mixture of R-134a, R-125 and R-32.

21. The lubricant composition according to claim 1, wherein said refrigerant is a mixture of R-143a and R-125.

22. The lubricant composition according to claim 1, wherein said refrigerant is a mixture of R-143a, R- 125 and R- 134a.

* * * * *